United States Patent [19]

Evans et al.

[11] 4,316,749

[45] Feb. 23, 1982

[54] PRODUCTION OF USP QUALITY LACTOSE

[75] Inventors: John W. Evans, Weed; Gary C. Young, Visalia, both of Calif.

[73] Assignee: Stauffer Chemical Company, Westport, Conn.

[21] Appl. No.: 194,723

[22] Filed: Oct. 7, 1980

[51] Int. Cl.[3] ..... C13K 5/00

[52] U.S. Cl. ..... 127/55; 127/31; 127/58

[58] Field of Search ..... 127/31, 54, 58, 53, 127/55, 48

[56] References Cited

U.S. PATENT DOCUMENTS

| | | | |
|---|---|---|---|
| 2,437,080 | 3/1948 | Daniel | 127/54 X |
| 2,467,453 | 4/1949 | Almy | 127/31 |
| 2,477,558 | 8/1949 | Almy | 127/31 |
| 2,768,912 | 10/1956 | Peebles | 127/31 |
| 3,785,865 | 1/1974 | Pollard | 127/31 X |
| 4,099,983 | 7/1978 | Wittenberg | 127/31 X |

OTHER PUBLICATIONS

A. E. Martell et al., "Chemistry of the Metal Chelate Compounds", 490–495, Prentice-Hall, Englewood Cliffs, 1956.

Chemical Abstracts, 55:P23869 (1961).

*Primary Examiner*—Sidney Marantz

*Attorney, Agent, or Firm*—Vivienne T. White

[57] ABSTRACT

A method of producing USP quality lactose which involves (a) adding to lactose rich permeate derived from passing whey through a semipermeable membrane an effective amount of a food grade chelating agent;

(b) filtering the lactose rich permeate through a simple filtration system at from about 71°–88° C.;

(c) crystallizing the lactose from the permeate at a temperature of from 10°–24° C.; and (d) heating the permeate and lactose crystals to from about 32°–44° C.; and (e) separating, washing and drying the USP quality lactose product.

12 Claims, No Drawings

PRODUCTION OF USP QUALITY LACTOSE

BACKGROUND OF THE INVENTION

Lactose or milk sugar is obtained by crystallization from a milk derived source such as cheese whey. Whey as a byproduct of cheese manufacture is available in about 3.5 billion gallons per year. Numerous methods have been devised to extract the valuable lactose and protein from whey. In one method, whey protein is concentrated by passing the whey through an ultrafiltration membrane. The protein is removed leaving the lactose rich permeate. Lactose crystallized in the conventional manner from whey contains impurities. Protein, salts, riboflavin (a coloring matter), present during the conventional crystallization process contaminate the lactose, especially, if they become insoluble during the process of concentrating the permeate.

A relationship between riboflavin absorption by lactose and the lactose concentration of whey has been disclosed by Leviton in Volume 36, Industrial and Engineering Chemistry, pg. 744. In discussing the added influence of temperature on the absorption of riboflavin by lactose, Leviton discloses that it is possible to crystallize a portion of lactose free of riboflavin. A process incorporating the teachings of Leviton, however, would be commercially unacceptable due to the low lactose yields which result.

USP lactose is conventionally produced from edible grade lactose by dissolving the edible grade lactose in hot water, treating the solution with activated charcoals and filtering the solution using a diatomaceous earth filter to remove the impurities. The lactose is then recrystallized from the supersaturated solution, centrifuged, washed and dried to produce the white appearing USP lactose. The conventional process described above is time consuming and not cost effective.

It is therefore, an object of the present invention to devise a less complex and more cost effective method of producing USP quality lactose.

SUMMARY OF THE INVENTION

A simple and economical process for producing USP quality lactose has been discovered. In the novel process for producing USP quality lactose, lactose is directly crystallized from the lactose-rich permeate derived by passing whey through a semi-permeable membrane, then centrifuged and washed without the need for further recrystallization or purification treatment. The novel process comprises the steps of:

1. Adding to the lactose rich permeate derived from passing through a semipermeable membrane an effective amount of a food grade chelating agent;
2. Filtering the lactose rich permeate through a simple filtration system at about 71°-88° C. (160°-190° F.);
3. Crystallizing the lactose from the permeate at a temperature of from about 10°-24° C. (50°-75° F.);
4. Heating the permeate and lactose crystals to from about 32°-44° C. (90°-110° F.) to relieve the supersaturation, and
5. Separating, washing and drying the USP quality lactose product obtained.

DETAILED DESCRIPTION OF THE INVENTION

Permeate derived or prepared from a sweet whey or acid whey, i.e. cheddar, cottage, cream, Swiss and mozzarella can be used in the practice of this invention.

Permeate is a byproduct resulting from passing wheys through a semipermeable membrane.

Ultrafiltration, a representative method, is disclosed in Horton, B.S. et al., Food Technology, Vol. 26, No. 2, page 30, 1972.

In a typical process, acid whey is neutralized to a pH of from 6.4 to 7.0 with 50% caustic. After storage, the pH is adjusted to about 7.2 and any solids or precipitates can be removed by centrifugal clarifiers. The clarified liquor is then pasteurized. The pasteurized liquor is then fed into a ultrafiltration membrane unit. Membranes having molecular weight cut-off equal to or less than 20,000 can be used. If a membrane having a 20,000 molecular weight cut-off is used, the permeate solids generally comprises from about 4% to about 6% protein (based on total Kjeldahl nitrogen-TKN); from about 10% to about 15% ash, normally 11%; substantially low fat and the remainder comprising lactose.

The preferred permeate product used in the present invention is the permeate resulting from the ultrafiltration of whey. The permeate generally has a concentration of solids between 5% to 12% after ultrafiltration. The solution then can be concentrated using normal concentration techniques such as evaporators, to form a solution containing from about 34% to about 42% and preferably 40% dissolved solids.

This concentrated permeate solution can be further concentrated at an elevated temperature to provide a solution of lactose, containing about from 58% to about 70% total dissolved solids, preferably about 63%. In the prior art process, this solution at approximately 70° C. (158° F.) (or from about 55° C. (131° F.) to about 80° C. (176° F.)) is conveyed to crystallizers where the lactose is then separated by conventional means such as filters, centrifuges, basket centrifuges and the like, then directly washed and dried or redissolved and recrystallized to improve purity, as is normally accomplished with activated charcoal and bone and char and/or filtration through diatomaceous earth filters.

In a novel process of the invention, the supersaturated permeate solution having a solids content of from about 58 to about 70% dissolved solids, preferably about 63% is filtered by any simple filtration method at a temperature above the lactose crystallization temperature and generally at from 160°-190° F. (71°-88° C.), preferably 175° F. (80° C.). Thereafter, the lactose rich permeate is conveyed to crystallizers at a temperature of 70° C. (158° F.) to 80° C. (176° F.), and the lactose is allowed to crystallize out as the temperature is reduced to from 10° C. (50° F.) to 24° C. (75° F.). After a sufficient holding time of from about 10 to 20 hours, the supersaturated lactose-permeate solution is reheated to a temperature of from about 32° C. (90° F.) to 44° C. (110° F.) to relieve the supersaturation without dissolving the lactose crystals. Thereafter, the lactose crystals are separated by conventional means, such as by centrifuge, and the like and then dried directly.

Suitable chelating agents disclosed in co-pending U.S. application Ser. No. 194,722, entitled Production of a Stable Lactose Product filed on the same day as the instant application commonly assigned herewith, and incorporated herein by reference are added prior to crystallization and preferably before concentrating the permeate to the 58 to 70% dissolved solids level. Chelating agents such as alkali metal polyphosphate and salts of ethylenediaminetetraacetic acid are suitable.

The chelating agent can be conveniently added to the permeate in the form of an aqueous solution.

The polyphosphate can be dissolved in water to form an aqueous solution having from 10–40 wt. % of the polyphosphate and preferably 15 to 25 wt. %. The solution can be metered into the permeate solution in amounts sufficient to desirably provide from about $2.5\times10^{-5}$ to about $1\times10^{-2}$ and more desirably about $2\times10^{-4}$ to $5\times10^{-4}$ grams polyphosphate per gram of permeate solids in the solution. The alkali metal polyphosphate of which SHMP is the preferred composition is preferably used in an amount ranging from about $2.6\times10^{-4}$ to $4.5\times10^{-4}$ grams of polyphosphate per gram of permeate solids. The polyphosphate, however, is effective when added in amounts equal to or greater than $2.5\times10^{-5}$ grams per gram permeate solids.

The EDTA salt for instance can also be dissolved in water to form an aqueous solution having 0.5 to 39 wt. % of the EDTA salt and preferably 10 to 29 wt. %. The solution can be metered into the permeate solution in amounts sufficient to desirably provide from about $2.5\times10^{-5}$ to about $1\times10^{-2}$ and more desirably about $2\times10^{-4}$ to $5\times10^{-3}$ grams EDTA salt per gram of permeate solids in the solution. The EDTA salt of which the disodium salt is the preferred composition is preferably used in an amount ranging from about $4\times10^{-4}$ to $4\times10^{-3}$ grams of EDTA salt per gram of permeate solids.

The addition of food grade chelating agents such as disclosed in the co-pending application, incorporated herein by reference, to the permeate is accomplished with sufficient agitation so that it can be uniformly distributed throughout the concentrate. The use of the small amount of the chelating agent as disclosed provides lactose which has a stable pH and reduced ash content. The exact dosage of chelating agent is proportional to the amount of impurities to be removed or prevented from entering the lactose product.

The chelating agent is most conveniently added to the partially concentrated permeate solution having a total solids content of 33–40% or prior to evaporation when the permeate has a 5–12% total solids content. Chelating agents such as sodium hexametaphosphate (SHMP) or the disodium salt or the tetrasodium ethylenediaminetetraacetic acid are particularly desirably added in the practice of the invention.

The lactose produced in accordance with the disclosed invention is white in appearance and meets USP lactose product requirements.

The following example is illustrative of the novel method disclosed herein.

EXAMPLE 1

Permeate derived from the ultrafiltration of acid whey was concentrated by evaporation to a 60–65% total solids level at a temperature of about 80° C. (175° F.). An aqueous mixture of sodium hexametaphosphate (SHMP) was added in an amount corresponding to $4.0\times10^{-4}$ grams of SHMP per gram of permeate solids. Three portions of the permeate material were filtered at 80° C. (175° F.) through Pall BC Filter® polypropylene cartridge filter made by Pall Trinity Micro Corporation of Cortland, N.Y. Duplicate control samples were not filtered and were crystallized at 70° F. (21° C.) and basket centrifuged. The filtered samples of permeate were cooled to 21° C. (70° F.) at which temperature the lactose crystallized from the supersaturated solutions. Thereafter, the supersaturated permeate samples were heated to 90°–105° F. (32°–41° C.) to relieve the supersaturation without redissolving the lactose crystals. The samples were then basket centrifuged. The duplicate controlled samples and the samples produced in accordance with the invention were then washed with cold water, repulped on a 50/50 basis with cold water and recentrifuged, washed again in cold water and dried.

Table 1 below shows the analysis of the controls and the samples of the USP alpha lactose hydrate produced in accordance with the invention.

TABLE 1

| | Ash % Weight As Is | TKN % Weight As Is | pH | b-index |
|---|---|---|---|---|
| Control 1 | 0.12 | 0.32 | 6.11 | 6.2 |
| Control 2 | 0.12 | 0.39 | 6.02 | 5.4 |
| Sample 1 | 0.02 | 0.02 | 5.15 | 1.9 |
| Sample 2 | 0.04 | 0.02 | 5.08 | 2.2 |
| Sample 3 | 0.03 | 0.03 | 5.23 | 2.3 |

| | % Water | Absorbance Units of (10% solution) | USP Clarity (color) |
|---|---|---|---|
| Control 1 | 5.18 | .566 | poor |
| Control 2 | 5.18 | .599 | poor |
| Sample 1 | 5.15 | .017 | clear |
| Sample 2 | 5.15 | .016 | (not run) |
| Sample 3 | 5.15 | .013 | clear |

A Neotec Tru-color Colorimeter from Neotec Instruments, Inc. of Minneapolis, Minn. was used to measure the color. The results obtained is reported in absorbance units and the b-index columns in accordance with the method disclosed by Faulhaber and Witherell in Applied Optics, Vol. 10, page 970, (April, 1971) and by Glasser et al. in Journal of the Optical Society of America, Vol. 48, No. 10, p. 736–740 (October, 1958).

The pH were run on 10% solutions of the lactose test samples and control samples. The color clarity tests were conducted by dissolving 3 grams of sample in 10 ml. of boiling water.

The high clarity (low absorbance) of the product is attributed to filtration and to the heat treatment before crystallization which is thought to increase the precipitation of calcium salts and denaturation of proteins and to the addition of chelating agents which reduce impurity levels in the final lactose product.

What is claimed is:

1. A method of producing USP quality lactose comprising the steps of:

(a) adding to lactose rich permeate derived from passing whey through a semipermeable membrane an effective amount of a food grade chelating agent;

(b) filtering the lactose rich permeate through a simple filtration system at from about 71°–88° C.;

(c) crystallizing the lactose from the permeate at a temperature of from about 10°–24° C.; and (d) heating the permeate and lactose crystals to from about 32°–44° C.;

(e) separating, washing and drying the USP quality lactose product.

2. The method of claim 1, wherein the chelating agent is an alkali metal polyphosphate.

3. The method of claim 2, wherein the alkali metal polyphosphate is sodium hexametaphosphate.

4. The method of claim 1, wherein the chelating agent is a salt of ethylenediaminetetraacetic acid (EDTA).

5. The method of claim 4, wherein the EDTA salt is the disodium salt.

6. The method of claim 4, wherein the EDTA salt is the tetrasodium salt.

7. A method of producing USP lactose comprising the steps of:

(a) adding to lactose rich permeate derived from the ultrafiltration of whey an effective amount of a food grade chelating agent;

(b) filtering the lactose rich permeate through a simple filtration system at from about 71°–88° C.;

(c) crystallizing the lactose from the permeate at a temperature of from about 10°–24° C.;

(d) heating the permeate and lactose crystals to from about 32°–44° C. then;

(e) separating, washing and drying the USP quality lactose product.

8. The method of claim 7, wherein the chelating agent is an alkali metal polyphosphate.

9. The method of claim 8 wherein the alkali metal polyphosphate is sodium hexametaphosphate.

10. The method of claim 7, wherein the chelating agent is a salt of ethylenediaminetetraacetic acid (EDTA).

11. The method of claim 10, wherein the EDTA salt is the disodium salt.

12. The method of claim 10, wherein the EDTA salt is the tetrasodium salt.

* * * * *